US005671798A

United States Patent [19]

Landua et al.

[11] Patent Number: 5,671,798

[45] Date of Patent: Sep. 30, 1997

[54] SHOOTING HEAD FILLING DEVICE

[75] Inventors: Werner Landua, Mannheim; Werner Pichler, Brühl, both of Germany

[73] Assignee: Adolf Hottinger Maschinenbau GmbH, Mannheim, Germany

[21] Appl. No.: 624,446

[22] PCT Filed: Oct. 6, 1994

[86] PCT No.: PCT/DE94/01169

§ 371 Date: Apr. 5, 1996

§ 102(e) Date: Apr. 5, 1996

[87] PCT Pub. No.: WO95/10375

PCT Pub. Date: Apr. 20, 1995

[30] Foreign Application Priority Data

Oct. 7, 1993 [DE] Germany ..... 43 34 118.7

[51] Int. Cl.[6] ..... B22C 15/26; B22C 19/04

[52] U.S. Cl. ..... 164/150.1; 164/155.7; 164/201

[58] Field of Search ..... 164/200, 201, 164/202, 150.1, 151.2, 4.1, 456, 19, 20, 21, 22, 155.7

[56] References Cited

U.S. PATENT DOCUMENTS 5,078,201 1/1992 Nakamura .

FOREIGN PATENT DOCUMENTS

| | | | |
|---|---|---|---|
| 1 025 108 | 2/1958 | Germany . | |
| 2 304 564 | 8/1974 | Germany . | |
| 55-126344 | 9/1980 | Japan . | |
| 3-42142 | 2/1991 | Japan . | |
| 4-266448 | 9/1992 | Japan . | |
| 1507509 | 9/1989 | U.S.S.R. | 164/4.1 |
| 2 199 777 | 7/1988 | United Kingdom . | |
| WO93/04800 | 3/1993 | WIPO . | |

*Primary Examiner*—J. Reed Batten, Jr.
*Attorney, Agent, or Firm*—Bell, Seltzer, Park & Gibson, P.A.

[57] ABSTRACT

The device comprises a filling assembly (6) with a storage hopper (3) for molding material (2), an outlet member (4) for discharging the molding material (2) into the shooting head (1), and a gate (5) for closing the outlet member (4), the filling assembly (6) being mounted for vertical movement on a machine frame (7) for purposes of immersing the outlet member (4) into the shooting head (1) that is to be filled. To ensure that, on the one hand, the filling assembly (6) is filled with the molding material (2) in an accurately predeterminable and reproducible manner and that, on the other hand, the filling level of the filling assembly (6) is accurately determined, the device is designed and constructed such that a weighing device (8) for determining the weight of the filling assembly (6) is arranged between the filling assembly (6) and the machine frame (7).

2 Claims, 1 Drawing Sheet

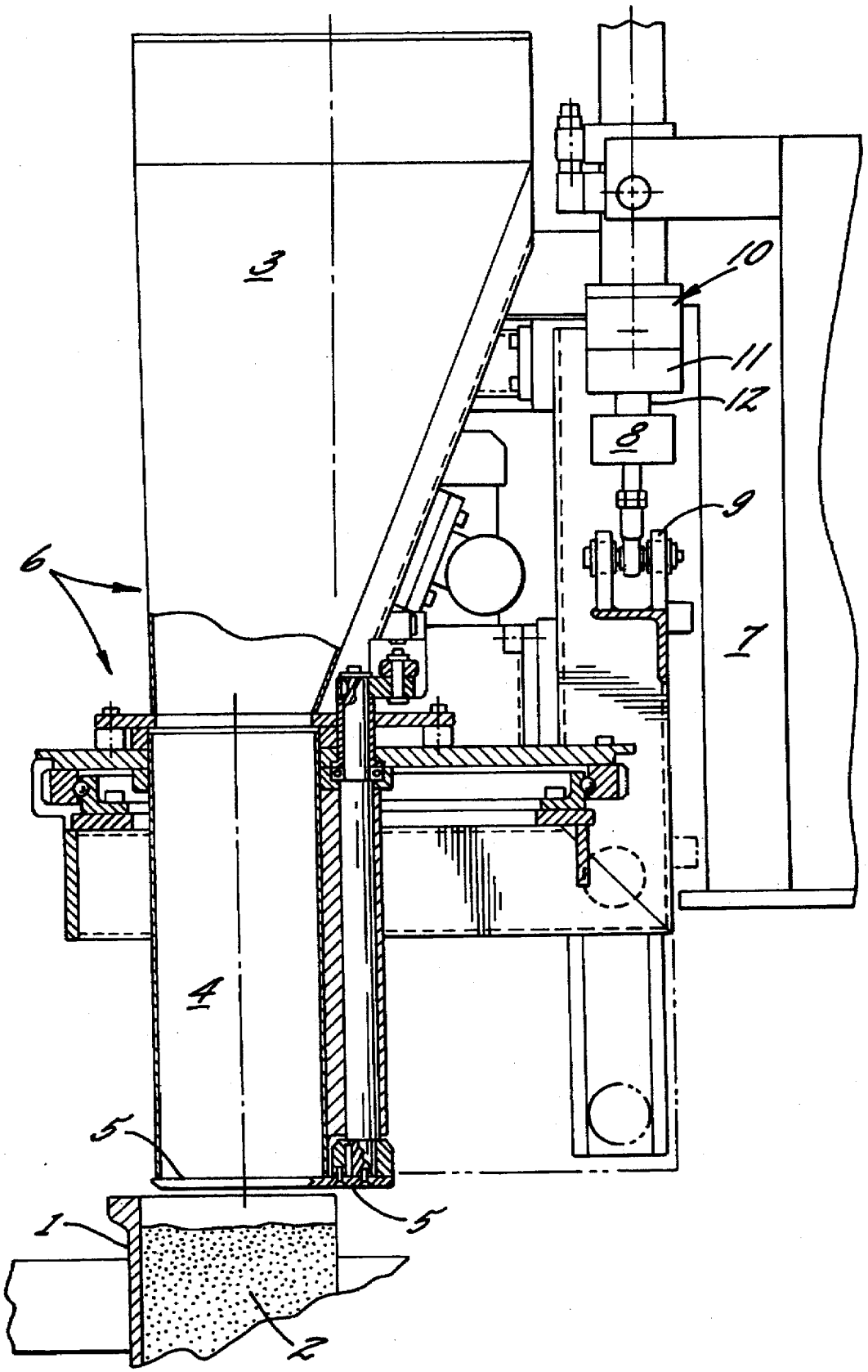
3
10
11
12
8
9
6
7
4
5
5
1
2

SHOOTING HEAD FILLING DEVICE

BACKGROUND OF THE INVENTION

The invention relates to a device for filling shooting heads with molding materials, the device being provided with a filling assembly that comprises a storage hopper for the molding material, an outlet member for discharging the molding material into the shooting head, and a gate for closing the outlet member, the filling assembly being mounted on a machine frame for vertical movement so as to immerse the outlet member into the shooting head to be filled.

In the foundry practice, core shooting machines have been known for many years. For casting molded products, the foundry cores or molds are made in most cases as separate parts. They are combined and joined to each other to form a casting mold. An essential component of the core shooting machines are the so-called shooting heads with shooting plates accommodating the shooting nozzles. Molding sand, in particular core sand, i.e., a quartz sand previously compounded or coated with binding agents is supplied to the shooting heads under discussion, from which it is blown or shot under a very high air pressure into the respective molds through the nozzles arranged in the shooting plate.

DE 41 28 952 C1 discloses a known device for filling shooting heads with molding materials. However, this device is extremely problematic with respect to monitoring its filling level. The filling level of the known device, in particular in the region of the storage hopper is determined by means of measuring probes, which project from the outside into the storage hopper or terminate flush with the inside wall of the storage hopper, these measuring probes being provided at different heights for determining defined filling levels. However, on their measuring side, i.e., toward the interior of the storage hopper, these filling level probes have at least small steps or discontinuous transitions in their wall and, thus, form critical regions, to which the nonflowable or moist molding material may stick or adhere. In the course of several fillings, encrusted buildups form thereon, which are detected by the measuring probe as the filling level or the molding material. Consequently, the arrangement of the measuring probes under discussion involves a system-inherent imperfection to the extent that the measuring probe itself constitutes a cause for an erroneous measuring situation simulating a filling level as a result of material accumulations in the region of the measuring probe.

It is therefore the object of the present invention to improve and further develop a device for filling shooting heads of the kind under discussion, so that it is possible to determine with simple means the filling level of the storage hopper, or to exactly predetermine and even reproduce a filling of the filling assembly.

SUMMARY OF THE INVENTION

The device of the present invention for filling shooting heads achieves the foregoing object by the provision of a weighing device which is connected between the filling assembly and the machine frame, and so that the weighing device determines the weight of the entire filling assembly.

In accordance with the invention, the longstanding, proven method of determining the filling level by means of measuring probes has been discarded. Instead, it has been recognized that the filling level of the filling assembly or the storage hopper may be determined without adversely affecting the storage hopper, in that the entire filling assembly is weighed. Within the scope of a simplest configuration of the device in accordance of the invention, it would be possible to determine the net weight of the filling assembly before starting a first filling, and after determining accordingly the weight of the loaded filling assembly, the previously determined net weight would have to be deducted from the gross weight. With a known pouring density of the molding materials, the pouring volume could be calculated, if necessary, with the quantity of forming material required for shooting cores being easily definable by also indicating the weight.

Further, it will be advantageous, when the weighing device is adjusted or zeroed to the net weight of the entire filling assembly, so that the weight of the molding material being in the filling assembly may be determined directly by means of the weighing device. The adjustment to zero that is to be performed with respect to the filling assembly, would have the great advantage that a corresponding display indicates exclusively the weight corresponding to the loaded molding material. In this connection, it would likewise be possible—on the basis of the pouring density of the molding material and its filling-dependent volume—to directly indicate the direct correlation to the filling level after a preparation by a processor. A loading of the filling assembly could be controlled via thus-acquired data. Likewise in this instance, it would be necessary to take into account the quantity of molding material required for filling a shooting head as well as the number of the shooting heads to be filled with the contents, namely a load, of the filling assembly.

With respect to construction, the weighing device could be connected to the filling assembly and operate between the filling assembly and the machine frame. Additional guideways or further hinges between the filling device and the machine frame are advantageous for reasons of stability, it being necessary in this instance to ensure only that the weight of the filling assembly is in fact operative on the weighing device. Likewise, the weighing device could be connected to the machine frame, and operate between the machine frame and the filling assembly. With respect to hinging the weighing device, it is to be ensured only that same is operatively connected, on the one hand, with the filling assembly or a holder thereof and, on the other hand, with the machine frame or a corresponding holder thereof, and so that the mass of the filling assembly is operative on the weighing device unimpeded or without external influences.

With respect to a particularly ingenious arrangement of the weighing device it will be advantageous, when the weighing device is associated with a lifting mechanism that is connected to the machine frame or to the filling assembly and operates between the machine frame and the filling assembly. This lifting mechanism causes the filling assembly to move vertically for purposes of immersing its outlet member into the shooting head. More specifically, the lifting mechanism could comprise a cylinder-piston arrangement serving as a drive. In this connection, a weighing cell serving to bias the weighing device could form again an integral part of the cylinder-piston arrangement. Thus, the force applied could be measured, for example, via force gauges, on which the mass of the filling assembly is operative directly or indirectly, for example, even via a hydraulic pressure medium.

There exist various possibilities of perfecting and further developing the teaching of the present invention in advantageous manner. To this end, reference may be made to the following description of an embodiment of the invention with reference to the drawing. In conjunction with the preferred embodiment of the invention with reference to the drawing, also generally preferred embodiments and further developments of the teaching are described.

BRIEF DESCRIPTION OF THE DRAWING

The single drawing figure is a schematic side view of the device in accordance with the invention for filling shooting heads with a weighing device for determining the weight of the filling assembly.

The drawing illustrates schematically a device for filling a shooting head 1 with molding materials 2, the device comprising a filling assembly 6 with a storage hopper 3 for molding materials 2, an outlet member 4 for discharging the molding materials 2 into the shooting head 1, and a gate 5 for closing the outlet member 4, the filling assembly 6 being mounted for vertical movement on a machine frame 7 for purposes of immersing the outlet member 4 into the shooting head 1 that is to be filled.

In accordance with the invention, a weighing device 8 for determining the entire weight of the filling assembly is arranged between the filling assembly 6 and the machine frame 7. Essential in this arrangement is that the weighing device 8 is adjusted or zeroed to the net weight of the filling assembly 6, so that the weight of the molding material 2 contained in the filling assembly 6 can be determined by means of the weighing device, which is only schematically illustrated in the drawing.

As likewise shown in the drawing, the weighing device 8 is connected, on the one hand, to the filling assembly 6 or to a holder 9 arranged thereon and, on the other hand, to a lifting mechanism 10 operating between the machine frame 7 and the filling assembly 6, and it is thus operative between the filling assembly 6 and the machine frame 7. As illustrated, the lifting mechanism 10 comprises a cylinder 11 and piston 12, and the weighing device 8 comprises a weighing cell connected to the piston 12. However, it is likewise possible to integrate the weighing device 8 in the lifting mechanism 10. In this instance, the weight can be determined with reference to an increased pressure that develops in the cylinder-piston arrangement as a result of the mass of filling assembly 6.

Finally, it should be explicitly noted that the teaching claimed in the present invention relates basically to the determination of the filling level of a device for filling shooting heads, namely on the basis of determining the weight of the filling assembly. Any other developments of the teaching are possible, without being limited to the foregoing embodiment that has been described only by way of example.

We claim:

1. A device for filling shooting heads with molding material comprising a filling assembly comprising a shortage hopper for molding material, an outlet member connected to the storage hopper for discharging the molding material into a shooting head, and a gate for selectively closing the outlet member, means mounting the filling assembly for vertical movement on a machine frame for the purpose of immersing the outlet member into the shooting head, said mounting means including a lifting mechanism fixed between the filling assembly and the machine frame and which comprises a cylinder-piston arrangement, and a weighing device connected between the filling assembly and the machine frame for determining the weight of the filling assembly, said weighing device comprising a weighing cell connected to the cylinder-piston arrangement.

2. The device as defined in claim 1 wherein the weighing device is zeroed to the net weight of the filling assembly so that the weight of the molding material contained in the filling assembly is determined by the weighing device.

* * * * *